United States Patent [19]

Cobaugh et al.

[11] 3,955,877

[45] May 11, 1976

[54] LOW PROFILE CONTACT

[75] Inventors: Robert Franklin Cobaugh, Elizabethtown; James Ray Coller, Mechanicsburg, both of Pa.

[73] Assignee: AMP Incorporated, Harrisburg, Pa.

[22] Filed: June 23, 1975

[21] Appl. No.: 589,092

Related U.S. Application Data

[63] Continuation of Ser. No. 451,252, March 14, 1974, abandoned.

[52] U.S. Cl. ..... 339/258 P; 29/630 D; 339/276 SF

[51] Int. Cl.[2] ..... H01R 13/12

[58] Field of Search ..... 339/17, 18, 256, 258, 339/259, 262, 275, 276 SF; 29/630 R, 630 D

[56] References Cited

UNITED STATES PATENTS

| | | | |
|---|---|---|---|
| 3,609,640 | 9/1971 | Longenecker et al. | 339/258 P |
| 3,659,243 | 4/1972 | Gluntz | 339/258 R |
| 3,718,895 | 2/1973 | Reynolds et al. | 339/275 B |
| 3,796,988 | 3/1974 | Palombella | 339/258 R |
| 3,803,537 | 4/1974 | Cobaugh | 339/276 SF |
| 3,850,500 | 11/1974 | Cobaugh et al. | 339/258 R |

FOREIGN PATENTS OR APPLICATIONS

| | | | |
|---|---|---|---|
| 674,830 | 4/1939 | Germany | 339/258 R |

*Primary Examiner*—Joseph H. McGlynn
*Attorney, Agent, or Firm*—William J. Keating; Donald W. Phillion

[57] ABSTRACT

A low profile contact, stamped or cut from a section of flat stock material, for receiving a male pin for connection to a lead of a printed circuit board, includes a cylindrically shaped pin receiving portion for insertion into a hole in the printed circuit board conterminous with the lead. A plurality of tabs extend upwardly from the top of the cylinder, and a pair of opposite tabs are bent intermediate their ends to partially extend into the cylinder to engage the inserted pin. The tabs are flared outwardly from the top of the cylinder to provide a guide to assist insertion of the pin into the cylinder and to provide a seat upon which the contact seats upon the surface of the circuit board. The cylinder is formed with a gap or space parallel to its axis to enable it to be radially compressed upon insertion into the hole of the printed circuit board to urge or bear outwardly upon the walls of the hole to establish firm physical and electrical contact therewith. A connection member is attached to the bottom of the cylinder and extends through the printed circuit board when the contact is installed to receive external connection.

3 Claims, 4 Drawing Figures

LOW PROFILE CONTACT

CROSS-REFERENCE TO RELATED APPLICATION

This application is a continuation application of Ser. No. 451,252 filed Mar. 14, 1974, by Robert Franklin Cobaugh and James Ray Coller, now abandoned.

BACKGROUND OF THE INVENTION

1. Field of the Invention

This invention relates to electrical contacts, and more particularly to electrical contacts of the type for receiving a component lead to establish electrical connection between the lead and a conductor of a printed circuit board. The invention also relates to improvements in insertion type contacts of the type fabricated from flat stock material by a stamping process, which have reliable insertion capabilities.

2. Description of the Prior Art

A type contact in wide use today with printed circuit boards is a contact having a pin at one end and a female receptacle at the other. This contact is inserted through a hole in a printed circuit board so that the female portion is engageably secured to the wall of the hole in the printed circuit board and the pin portion thereof extends through the printed circuit board and forms a terminal post for one or more wires. Such wires can be connected to the terminal post in the well known wrap-around means or any other suitable methods for securing a wire to a post. Components having male pin type terminals are then mounted on the circuit board by insertion of said male pins into the female portion of the inserted contacts.

In certain applications such as hand calculators, where space is at a premium, it is desired that the female portion of insertion type contacts have a low profile, i.e., the receiving opening of said female portion should be nearly flush with the surface of the printed circuit board. As a result of such low profile contacts components mounted therein will also be positioned close to the surface of the printed circuit board, thereby conserving space. Up to the present time such low profile insertion type contacts have been fabricated by screw machine techniques. Moreover, in most types of screw machine fabricated contacts it has been necessary to insert a spring in the female portion of the contact in order to make the structure capable of retaining a male pin subsequently inserted therein.

Furthermore, in contacts fabricated by a screw machine technique, the female portion consists of a closed cylindrical section having very little spring, or give. Thus, the tolerances of both the diameter of such female portions and also the diameter of the hole in the printed circuit board must be maintained within close limits. If the hole in the printed circuit board is too large compared to the diameter of the female portion of the contact, neither a good mechanical or a good electrical contact will be made when the contact is inserted therein. On the other hand if the aperture in the printed circuit board is too small, the plating on the walls of the printed circuit board hole is very apt to be scraped away when the contact is inserted therein, thus producing a poor electrical contact.

A further disadvantage of the screw machine type insertion contact lies in the fact that not one, but two, electrical contacts must be made. Firstly, the male pin inserted therein must make good contact with the female portion of the insertion contact, and secondly, the insertion contact must make good electrical contact with the wall of the printed circuit board hole since the male pin does not make direct physical contact with the wall of said hole.

Low profile contacts have been proposed in which the contact presents a single element stamped from a section of a continuously fed supply of flat stock material, and having a female receptacle portion thereof which engages the wall of a hole in a printed circuit board through which the contact is inserted. The female portion of the contact is generally cylindrical in configuration and includes a tang or finger which is stamp formed from a portion of the cylinder wall and extends inwardly from the cylinder wall into the center portion of the cylinder. When a male pin or contact lead is inserted into the cylinder, the pin is forced by the tang against the cylinder wall and the wall of the printed circuit board through an open portion presented in the cylinder. The top portion of the cylinder is ouwardly flared to assist in the subsequent insertion of a male pin or component lead. Because the cylindrical portion is not complete, that is, because it has a "C" shaped cross-section, a portion of the flared out top does not close completely, and it is possible that the male pin will miss the hole and get hung-up on the edge of the circuit board, especially in mass production or machine effected operations.

SUMMARY OF THE INVENTION

In light of the above, it is, therefore, an object of the invention to present a contact for receiving a male pin or electrical component lead for insertion into a hole in a printed circuit board to establish electrical connection between the pin and the interior of the hole.

It is another object of the invention to present a low-profile contact for insertion into an aperture of a printed circuit board for receiving a male pin or electrical component lead and which facilitates the reliable insertion of the pin or lead.

It is still another object of the invention to present a low-profile contact for receiving an electrical component lead or male pin and establishing electrical contact between the lead or pin and the hole in the printed circuit board and which includes means for engaging the inserted pin or lead.

It is yet another object of the invention to present a plurality of contacts for gang insertion into holes or apertures of a printed circuit board for receiving a plurality of electrical component leads or male pins.

It is still another object of the invention to provide a plurality of contacts for receiving electrical component leads or male pins which includes means for providing spacing tolerance to facilitate gang insertion of the contacts.

These and other objects, features, and advantages will become apparent to those skilled in the art from the following detailed description, when read in conjunction with the accompanying drawings and appended claims.

The invention, in its broad aspect, presents a stamped, electrical contact formed of a single piece of stock material comprising an elongated portion, which includes an enlarged rectangular portion having a plurality of upwardly extending tabs. The rectangular portion is formed into a cylinder adapted to be inserted into a hole of a printed circuit board. A pair of oppositely positioned ones of the tabs are bent back upon themselves and downwardly into the cylinder towards each other to form a pair of spring contacts which will engage a male pin or electrical component lead inserted into the cylinder. Furthermore, the top portions of the aforementioned pair of bent-over tabs are also bent radially outwardly from the cylinder wall to form a flared entrance to the cylinder to facilitate insertion of said male pin or component lead into the cylinder.

A second pair of upwardly extending tabs are oppositely positioned in-between said pair of bent-over tabs and are also flared outwardly to facilitate insertion of a male pin or a component lead.

In another aspect of the invention, a plurality of contacts, each of a construction similar to that described above are carried upon a single header or carrier strip, which has "V" shaped channels intermediate adjacent contacts carried thereupon. The "V" shaped channels have an accordion effect which allows a degree of spacing tolerance between receiving holes in a printed circuit board to facilitate the gang insertion of the contacts in said receiving holes.

In accordance with another form of the invention, the second pair of upwardly extending tabs are curved to conform to the curvature of said cylinder so that the sides thereof extend close to the sides of said bent-over tabs, thereby providing better guidance of male pins into said cylinder.

To provide an even more certain guidance of said male pin into the cylinder and between said bent-over tabs, dimples or convex embossments are formed at the base of each of said second pair of tabs where said second pair of tabs join the said cylinder. Such dimples extend towards the interior of the cylinder and prevent an inserted male terminal from slipping off either side of said bent-over tabs.

BRIEF DESCRIPTION OF THE DRAWING

The invention is illustrated in the accompanying drawings, wherein.

In the various figures of the drawing, like reference numerals are used to refer to like parts. Additionally, the contacts illustrated are each of identical construction, and like reference numerals are used to denote corresponding parts of each of the contacts.

DETAILED DESCRIPTION OF THE PREFERRED EMBODIMENTS

Figure 1:
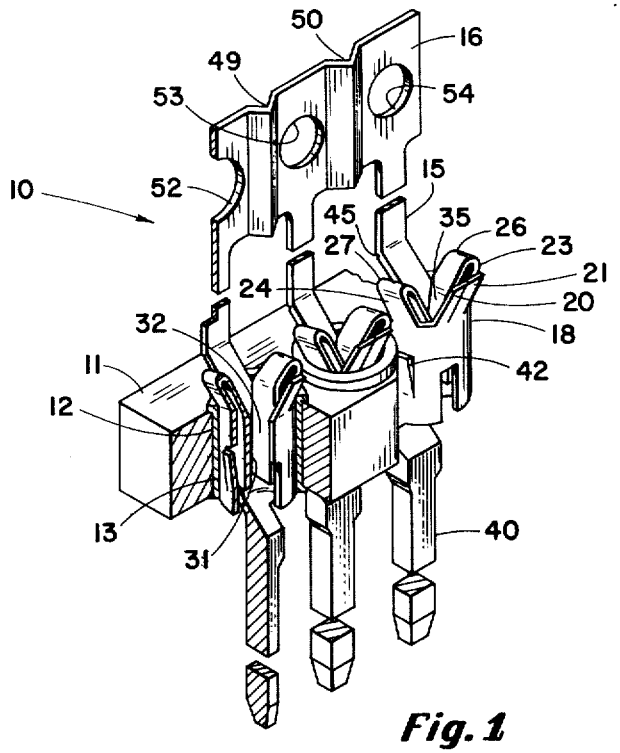
FIG. 1 is a perspective view, partially cut away, of three side-by-side contacts carried upon a common header and inserted into a printed circuit board, in accordance with the principles of the invention.
Figure 2:
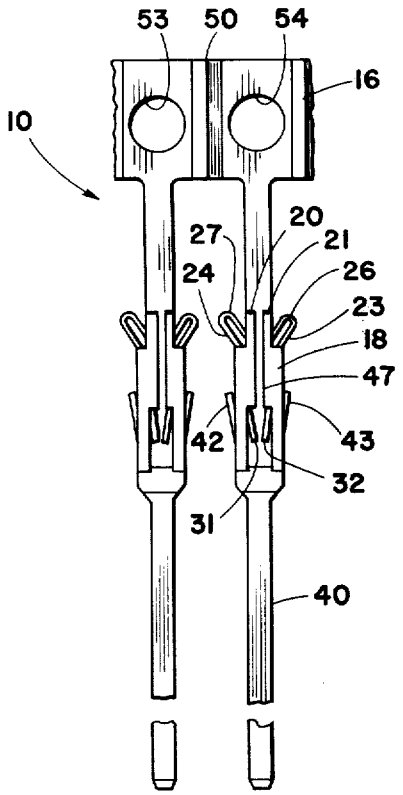
FIG. 2 is a front plan view of two of the contacts of FIG. 1, with the printed circuit board removed.
Figure 3:
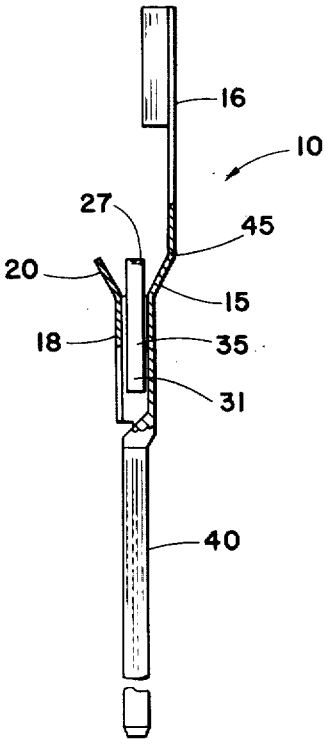
FIG. 3 is a side plan view, partly cut away, of one of the contactors of FIG. 2.

A contact assembly in accordance with the invention is generally denoted by the reference numeral 10, in FIGS. 1 – 3. The assembly 10 includes a plurality of contacts, three being illustrated in FIG. 1, for example. In FIG. 1, the contact assembly 10 is shown inserted into a printed circuit board 11 having apertures or holes, such as the hole 12. In accordance with generally used printed circuit board fabrication techniques, holes, such as the hole 12, through the circuit board substrate are commonly plates with a conducting layer 13, which is connected to leads (not shown) formed upon the printed circuit board 11. Electrical connection to the printed circuit board leads is then established by connection with the contact, in accordance with the invention. An electrical component lead or male pin, such as a component lead of an integrated circuit, transistor or the like, can then be inserted into the contact for connection to the desired printed circuit board lead.

The individual contacts of the contact assembly 10, include a tab or elongated member 15 by which the contacts are attached to a header 16. Each of the contacts additionally includes a rectangular or shouldered portion 18 which is formed into a cylindrical shape as shown. The cylindrically formed shoulder 18 is attached at its top to the tab 15. Upstanding or extending outwardly from the cylindrically shaped shoulder 18 are a plurality of tabs, tabs 20 and 21 at its end and tabs 23 and 24 at its sides. Thus, in the cylindrically formed configuration shown, the tabs 20 and 21 form a single tab essentially diametrically opposite the header attaching tab 15, and the tabs 23 and 24 are essentially diametrically opposed from each other, rotated 90° from the tabs 20, 21 and 15.

In addition, the tabs 23 and 24, are bent at a location intermediate the top of the shoulder 18 and the ends of the tabs, at points 26 and 27, to present a portion of each extending into the cylindrically formed shoulder 18. These inward extending portions 31 and 32 (shown particularly in the closestmost connector illustrated in FIG. 1), serve to engage the electrical component lead or male pin (not shown) inserted into the center 35 of the contact.

Finally, each of the tabs 20, 21, 23, 15 and 24 are outwardly flared, as shown, to facilitate the insertion of the component lead or male pin. Thus, in the insertion of such component lead or male pin into the interior 35 of the cylinder, the pin need not be precisely aligned with the axis of the cylinder to be enabled to be urged into the desired inserted location. If, for instance, the pin is brought into contact with one of the inwardly sloping faces of one of the tabs 20, 21, 23, 24, or 15, it will be guided thereby in the direction of the center of the cylindrical portion 18. Thus, the problems encountered, especially in gang insertion of male pins, in which the pin to be inserted catches on the circuit board or misses the contact completely are greatly reduced or eliminated.

Connected to the bottom of each of the contactors at the bottom of the cylindrically formed shoulder 18 is an elongated pin 40 to serve to enable external electrical connection to be made to the contact, by any suitable technique, such as wire wrapping, or the like.

On opposite sides of each of the contacts are formed tangs 42 and 43 (see FIG. 2) which engage the coating or plating material 13 (FIG. 1) within the hole 12 of the printed circuit board 11. The tangs are shown of rectangular configuration although other configurations could be equally advantageously employed.

In use, the entire assembly including a number of contacts to be inserted into corresponding holes or apertures of a printed circuit board can be carried by the common header or strip 16 and located over the desired printed circuit board holes. The entire assembly can then be lowered and gang inserted into the holes. The carrier strip 16 can then be removed, to produce a low profile contact. To facilitate the removal of the carrier strip 16, notches or scores 45 can be provided in the material on the back of the tabs 15, whereat the break would occur upon application of a transverse force to the carrier strip 16. Upon insertion, the flared tangs 42 and 43 on the contacts will engage the side wall of the aperture (the plated through material) with which it comes into contact to assure electrical connection with the contact and to enhance the physical connection in the inserted configuration. Subsequently, the male pins (not shown) of a component or other lead are inserted into the interior 35 of the cylindrically formed shoulder 18, whereupon, inwardly bent tabs 31 and 32 come into contact with the inserted lead to establish electrical connection with it, and to enhance the physical connection therewith. In addition, in the insertion of the contact, the flared aspect of the tabs 20, 21, 23, 15, and 24 provide a seat upon the surface of the printed circuit board 11 to thereby provide a low profile female contact means to receive male pin terminals, as above described.

As more specifically shown in FIG. 2, the cylindrically formed shoulders 18 each of the contacts is not completely closed. A gap 47 parallel to the axis of the cylinder is provided to enable the insertion of the contact into a hole in a printed circuit board having a diameter slightly less than the diameter of the cylinder. Thus, the shouldered portion 18 is radially inwardly compressed upon insertion into the holes of the printed circuit board, to thereafter present an outward bias against the hole of the printed circuit board to further enhance the stability of the contact within the board and the electrical connection made to the interiorly-disposed plated-through portion 13 (shown in FIG. 1).

To enable the socket assembly 10 to be inserted into holes for a printed circuit board in which the spacing tolerance is not precisely controlled, V-shaped notches 49 and 50 are formed upon the header 16 between the adjacent contacts. Thus, in the gang insertion of the contacts, if the holes are not precisely spaced, a certain degree of give or flexibility will be presented by the V-shaped sections 49 and 50 to enable the assembly to nonetheless be properly inserted.

It should be emphasized that the entire contact assembly 10 can be fabricated from a single flat piece of stock material. Thus, the material can be driven by known sprockets which engage, for example, holes, such as holes 52, 53 and 54, in the header 16 through a stamp or die to form the general outline or pattern. The shoulder portion 18 and the tabs upstanding from it can then be bent into the configuration illustrated. Thus, the contacts are of a single piece of material no other parts being needed in the fabrication process.

Figure 4:
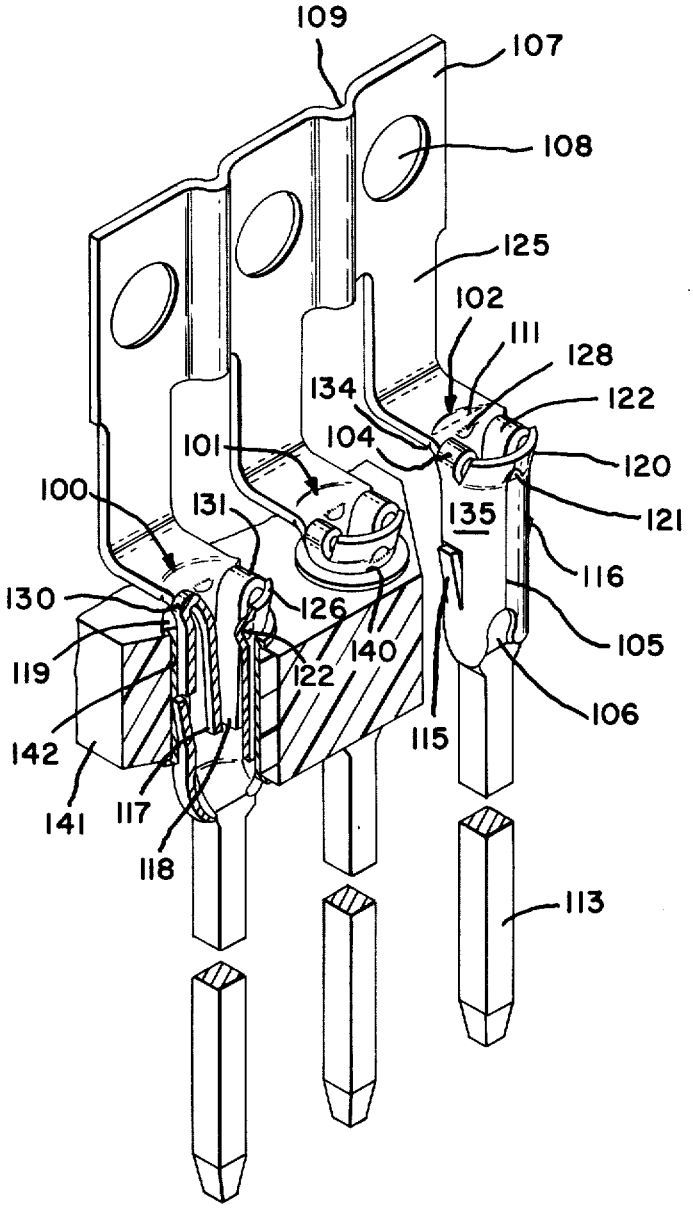
FIG. 4 is a perspective view, partially cut away, showing another form of the invention.

Referring now to FIG. 4 there is shown an alternative form of the invention. In FIG. 4 three contacts 100, 101 and 102 are shown, all connected to a common carrier 107.

Contact 102 is shown in its entirity. Contact 101 is shown inserted through an aperture 140 in printed circuit board 141, and contact 100 is also shown inserted through an aperture 142 in printed circuit board 141, but with a portion thereof cut away so that the internal configuration of the contact 100 can be seen.

Referring now specifically to contact 102, it can be seen that there is considerable similarity to the contact shown in FIG. 1. In FIG. 4 however, there are differences which provide certain advantages. Specifically, in FIG. 4 the tabs 120 and 111 are curved rather than straight, as in the case of the structure of FIG. 1. Furthermore, in the strucutre of FIG. 4, the dimples or depressions 121 and 128 are formed at the base of the tabs 120 and 111 where said tabs join the main body of the cylindrical portion 135 of the contact. The curving of tabs 120 and 111 of the contact 102 bring the ends of said tabs 120 and 111 closer to the sides of the bent-over tabs 104 and 122, thereby not only providing a larger circularly flared entrance for a male pin (not shown) to be inserted into the cylinder 135, but also to provide assurance that the inserted male pin will not slip off the sides of the two bent-over tabs 104 and 122.

As further assurance of maintaining the pin in-between the bent-over portions of the tabs 104 and 128 there is provided the embossments or dimples 121 and 128 which extend inwardly towards the interior of the cylinder and which provide a guiding means as well as a centering means for the male terminal inserted down into the cylinder 135.

The contact 102 is secured to carrier strip 107 via means 125. After insertion in a printed circuit board, carrier strip 107 and the connecting arm 125 usually is broken away from the contact at the notched portion 134 adjacent the top of tab 111.

As in the case of the structure of FIG. 1, the carrier strip 107 has V-shaped portions, such as V-shaped portion 109, in between the contacts, which provide a tolerance for variations in the spacing between apertures in the printed circuit board 141. The holes 108 in the carrier strip 107 are provided to engage a sprocket or equivalent means in automated machinery for gang insertion of a group of the contacts into the printed circuit board and also provide a means for positioning the contacts in a precise manner over a work station during the manufacturing thereof. Tangs 115 and 116 function to retain the contact 102 within a printed circuit board aperture once it is inserted therein. The terminal post 113 extends through the printed circuit board 141 and provides a means for another connection, such as a wire-wrap connection, for example.

The contacts, such as contact 102, are formed from a flat blank form, as discussed in connection with the structure of FIG. 1. When the cylinder 135 is formed, it is brought together at the seam 105. Also, to facilitate manufacture, an open area 106 is left near the bottom of the cylinder 135.

Referring now to contact 100, which has a section partially broken away, it can be seen that the ends of bent-over portions 117 and 118 of tabs 130 and 131 approach each other within the interior of the cylindrical portion of the contact and receive a male pin inserted therein, thereby making both an electrical contact therewith and also mechanically gripping the inserted male pin. In the broken away view of the contact 100, the structure of dimple 127 in tab 126 can be more clearly seen.

Ordinarily, the contacts, such as contacts 100–102 are inserted in a printed circuit board aperture which has some metallic coating, such as identified by reference character 119. This metallic coating can be plated on the interior of the aperture in the printed circuit board or it can be a metal bushing which is inserted in the printed circuit board.

Although the invention has been described and illustrated with a certain degree of particularity, it is understood that the present disclosure has been made only by way of example, and that numerous changes in the details of construction and combination and arrangement of parts may be resorted to without departing from the spirit and scope of the invention as hereinafter claimed.

We claim:

1. A circuit board connector for receiving an electrical conductor comprising:

a conductor receiving cylinder for insertion into a hole of the circuit board;

at least a pair of first tabs extending upwardly from opposite sides of the top of said cylinder and with a portion of each tab bent back upon itself to extend partially into said cylinder to engage the inserted electrical conductor; and a pair of second tabs oppositely positioned between said pair of first tabs, with each second tab being flared outwardly from the axis of said cylinder;

each second tab having a dimple formed therein near the juncture of said each second tab and said cylinder;

said dimple extending inwardly towards the interior of said cylinder to guide an inserted electrical connector in between the bent back portions of said pair of first tabs.

2. An article of manufacture for receiving a plurality of male terminals, stamped from a single, flat piece of metal for gang insertion into holes of a printed circuit board, and comprising:

a header; and a plurality of sockets each comprising:

a tab attaching said socket to said header;

a cylindrically shaped shoulder for insertion into a hole of the printed circuit board;

a pair of first tabs attached to a top of said cylinder, with each tab bent back upon itself between its ends to extend into the cylinder;

a member attached to the bottom of said cylinder for facilitating electrical connection to said socket; and a pair of second tabs being oppositely positioned between said first tabs;

each of said second tabs having a curved configuration generally concentric with said cylinder and flared outwardly from the axis of said cylinder;

in which each of said second tabs has a dimple formed therein near the juncture of said each second tab and said cylinder;

said dimple extending inwardly towards the interior axis of said cylinder to guide an inserted male terminal in between the bent-back portions of said pair of first tabs.

3. A stamped, electrical contact formed of a single flat piece of metal for connecting a conductor to a circuit board and comprising:

an elongated portion;

an enlarged rectangular portion on said elongated portion having a plurality of upwardly extending tabs;

said rectangular portion being formed into a cylinder which is retainable within a hole formed in a circuit board;

a first pair of said tabs being oppositely positioned and being bent back upon themselves intermediate the top of said cylinder and their ends with the bent back portions extending into said cylinder to engage a male terminal inserted into said cylinder; and a second pair of said tabs oppositely positioned between said first pair of tabs with each tab of said second pair of tabs having a curved configuration generally concentric with said cylinder and flared outwardly from the axis of said cylinder;

each tab of said second pair of tabs comprising a dimple formed therein near the juncture of said each second tab and said cylinder;

said dimple extending inwardly towards the interior axis of said cylinder to guide an inserted male terminal in between the bent-back portions of said first pair of tabs.

* * * * *